US007400242B2

(12) United States Patent
Martin

(10) Patent No.: US 7,400,242 B2
(45) Date of Patent: Jul. 15, 2008

(54) EXIT ARMING DELAY SECURITY SYSTEM AND METHOD

(75) Inventor: Christopher D. Martin, Plainview, NY (US)

(73) Assignee: Honeywell International Inc., Morristown, NJ (US)

( * ) Notice: Subject to any disclaimer, the term of this patent is extended or adjusted under 35 U.S.C. 154(b) by 200 days.

(21) Appl. No.: 11/048,477

(22) Filed: Jan. 31, 2005

(65) Prior Publication Data

US 2006/0181408 A1 Aug. 17, 2006

(51) Int. Cl.
*G08B 23/00* (2006.01)

(52) U.S. Cl. ..... 340/528; 340/541; 340/506; 340/527

(58) Field of Classification Search ..... 340/541, 340/506, 527, 528, 529, 5.1, 5.2
See application file for complete search history.

(56) References Cited

U.S. PATENT DOCUMENTS 5,400,246 A * 3/1995 Wilson et al. ..... 700/17
5,801,625 A 9/1998 Wang

FOREIGN PATENT DOCUMENTS

ES 2 176 107 A1 11/2002

OTHER PUBLICATIONS

Honeywell Galaxy User Guide.
Secuity House Galaxy Brochure.

* cited by examiner

*Primary Examiner*—Daryl C Pope
(74) *Attorney, Agent, or Firm*—Dalia S. Grimberg; John Beninati; Robert S. Smith

(57) ABSTRACT

A security system for protecting a building which includes at least a first presence sensor, an alarm panel that includes a microprocessor and memory, an exit delay in the alarm panel providing an interval for a user to exit the building after arming the security system, a reset of the exit delay providing a still further interval for a user to exit the building after arming the security system, the reset being initiated by the first presence sensor. The invention also includes the method for protecting a building which includes providing at least a first presence sensor, providing an alarm panel that includes a microprocessor and memory, providing a reset in the alarm panel having an interval for a user to exit the building after arming the security system, and initiating the reset in the alarm panel to provide an interval for a user to exit the building after arming the security system. The reset is initiated by the first presence sensor. Or other type of interior protection!

20 Claims, 2 Drawing Sheets

EXIT ARMING DELAY SECURITY SYSTEM AND METHOD

FIELD OF THE INVENTION

The present invention relates to the field of security systems for homes and businesses and particularly to methods and apparatus relating to an exit delay. Increasing theft and violence demand improved security systems to prevent crime, vandalism and terrorism. Modern security systems can detect perimeter violations and entry intrusions.

BACKGROUND OF THE INVENTION

Prior art security systems include a special zone type known as Entry/Exit type. This type of zone allows the end user sufficient time to exit the protected premises after arming the security system. This is known as the "exit delay" or "exit arming delay" period. Such a delay is ordinarily initiated when the arming process is initiated by a keypad, key switch or key fob. Some known systems include a predefined key on a keypad to allow the occupant to manually reset the entry delay. The "Entry Delay" period is the amount of time the user has to disarm the system once an entry door is opened when the system has been previously armed. The exit delay is programmed by the installer of the security system and is typically between 30 and 120 seconds in length, but may be longer. In addition, some security systems will automatically "reset" the exit delay back to the originally programmed maximum delay when an entry door has been reopened before the exit delay expires.

While the present invention has particular application to systems that include such an exit delay, and to resetting that delay under specific circumstances. However, it will be understood by those skilled in the art that the present invention also has application to a system that does not include the conventional exit delay. Thus, references herein to providing an arming delay include both an arming delay that is implemented by resetting a conventional exit delay upon the occurrence of specific events as well as an arming delay that is implemented in a manner that does not involve any reset of a circuit or system. For example, the systems of the present invention may condition actual arming of a system on a physical or software or gate that will not allow arming of the security system if either the conventional exit delay system or the system described in greater detail herein functions to prevent arming of the security system.

SUMMARY OF THE INVENTION

It is an object of the present invention to provide a security system having innovative control possibilities that have not been suggested by the prior art.

Another object of the invention is to provide a method and apparatus that provides an exit delay that reflects the needs and preferences of the end user.

Still another object invention is to provide a system and method that provides an exit delay that is not a fixed interval.

A further object of the invention is to provide an additional feature to systems, that include an exit arming delay, that will be reset that exit arming delay.

Yet another object of the invention is to provide a system that provides an exit delay without any user intervention.

It has now been found that these and other objects of the invention may be attained in a security system for protecting a building which includes at least a first presence sensor, an alarm panel that includes a microprocessor and memory, an exit arming delay in the alarm panel to provide an interval for a user to exit the building after arming the security system, the exit arming delay being initiated by the first presence sensor.

In some forms of the apparatus the exit arming delay duration is programmable. The security system may also have an exit arming delay interval that may occur more than one time. In addition, the security system may have an exit arming delay that may occur more than one time and the maximum number of the exit arming delay is programmable. Some embodiments of the security system may have such an exit arming delay that cannot occur until a predetermined interval has elapsed. The predetermined interval may be programmable. In some cases the first such exit arming delay cannot occur until a predetermined interval has elapsed. That predetermined interval may be programmable. The security system may further include a zone system and the first presence detector may be in a zone that may be proximate to a predefined exit door. In some cases a still further entry delay is initiated by a predefined door opening within a predefined time period after the security system has been armed, followed by the predefined door and closing.

Some embodiments of the present invention also include the method for protecting a building which includes providing at least a first presence sensor, providing an alarm panel that includes a microprocessor and memory, providing exit arming delay in the alarm panel to provide an interval for a user to exit the building after arming the security system, and providing an exit arming delay in the alarm panel to provide a still further interval for a user to exit the building after arming the security system that is initiated by the first presence sensor.

In some cases the step of providing an exit arming delay includes further providing a programmable exit arming delay. The step of providing an exit arming delay may include providing exit arming delay that may occur more than one time. The step of providing an exit arming delay may include the step of providing an exit arming delay that occurs more than one time and the maximum number of the exit arming delays is programmable. The step of providing exit arming delay may include providing a step of providing an exit arming delay that cannot occur until a predetermined interval has elapsed. The step of providing an exit arming delay may include providing an exit arming delay that cannot occur until a predetermined interval has elapsed and the predetermined interval is programmable.

The step of providing an exit arming delay may include providing an exit arming delay that cannot occur until a predetermined interval has elapsed. The step of providing an exit arming delay includes providing that the first of such exit arming delays within a predetermined time interval cannot occur until a predetermined interval has elapsed and that predetermined interval is programmable.

The method may further include providing a zone system and providing at least a first presence detector in a zone proximate to a predefined exit door. The method may further include a still further exit delay initiated by a predefined door opening within a predefined time period after the security system has been armed, followed by the predefined closing.

BRIEF DESCRIPTION OF THE DRAWING

The invention will be better understood by reference to the accompanying drawing in which.

DESCRIPTION OF THE PREFERRED EMBODIMENTS

Figure 1:
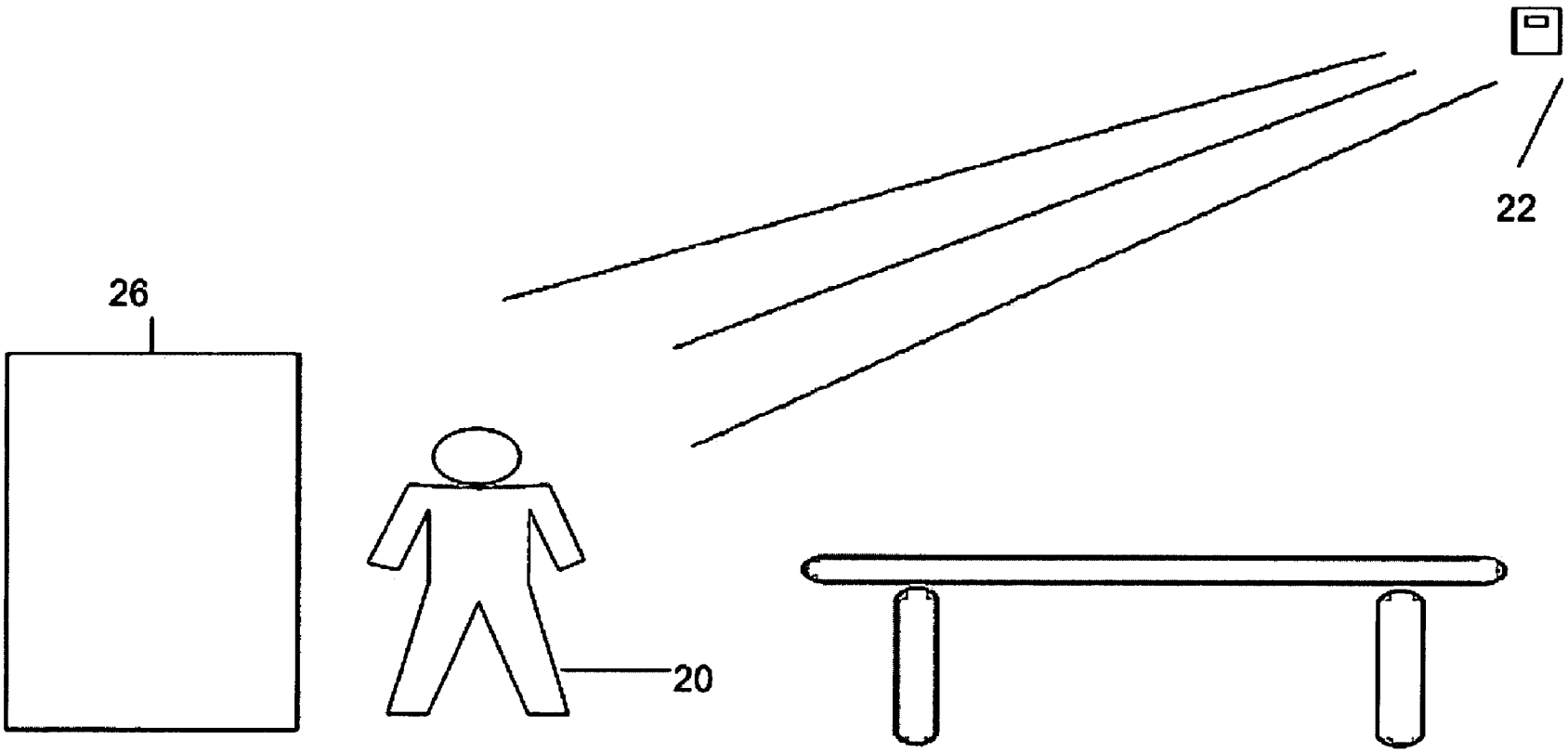
FIG. 1 is a diagrammatic view of an area within a protected premises monitored by a motion detector that is coupled to the security system.

The prior art includes a variety of security systems intended for homeowners, business owners, and other potential targets for burglary, that are monitored by a central station. Ideally a security and surveillance system should provide for the protection of the entire perimeter of a protected premises as well as visual- and audio-based surveillance monitoring. Security system sensors are available that are designed to detect sound, window and door intrusion, air movement, body heat, motion, and other conditions that indicate an intruder is present. A good security system design should consider the best plan for existing homes as well as new construction. It should also consider the lifestyle of all the inhabitants, the location of valuables or any items to be protected, how the system is to be controlled, adequate smoke and fire alerting sensors, and the type of emergency response required.

These systems are vastly superior to older systems that merely sound a bell or alarm. They have also largely replaced systems that were tied in directly to the local police station. As the use of burglar alarms increased, the local police departments began turning down more and more requests to be "hooked-up." As a result, there became a demand for central stations, or companies whose specialty it was to simply monitor burglar alarms. Most police departments will still allow banks and large jewelry stores a direct link to the police station, but as a rule, homeowners are excluded. So as the demand for security has risen, many guard agencies and burglar alarm installers have begun to offer centralized monitoring as an option for their clients.

When such systems are installed, it is common for them to be connected by a dedicated telephone line to the central station. Other systems utilize radio frequency and the internet to connect to the central station. In the event of an intrusion, the control panel (also known as a security panel) on the premises being monitored calls up the central station and gives an electronic message to the answering computer. It tells the computer exactly which switch or sensor has been violated, and the computer then tells the operator what has happened. For example if a burglar entered through a broken window, the panel would connect with the central station computer and tell it that zone 4, a first floor window, has been broken. The operator would then see on his computer screen that Acct. #1234, the Johnson residence has had zone 4, the window foiling on the living room window, violated. As the thief progresses through the house, the panel would call the central station for every sensor that was violated. The operator may then receive 1234-17, meaning that zone 17, a passive Infra-Red detector in the master bedroom, has detected someone. In some cases pre-amplified microphones allow audio monitoring of the protected premises. The operator would then be fairly sure someone was in the house, so the operator would have three options. The operator may just send the companies guards to the scene, call 911 and dispatch the police, or he may send both the police and the guards.

Passive infrared alarms are so called because they do not emit Infrared energy, but merely detect a change in Infrared energy. A passive infrared sensor probes its monitoring area, and if any changes are detected in Infrared (heat), it triggers an alarm. The passive infrared sensor apparatus records the ambient room temperature so it will notice any changes in IR such as those that are produced by the human body. Slow temperature changes, such as thermostatically controlled heating systems, will not interfere with the PIR's function.

The present invention may be utilized in security systems that include wireless connections between the control panel and the individual sensors as well as systems having wired connections between the sensors and the control panel.

Figure 2:
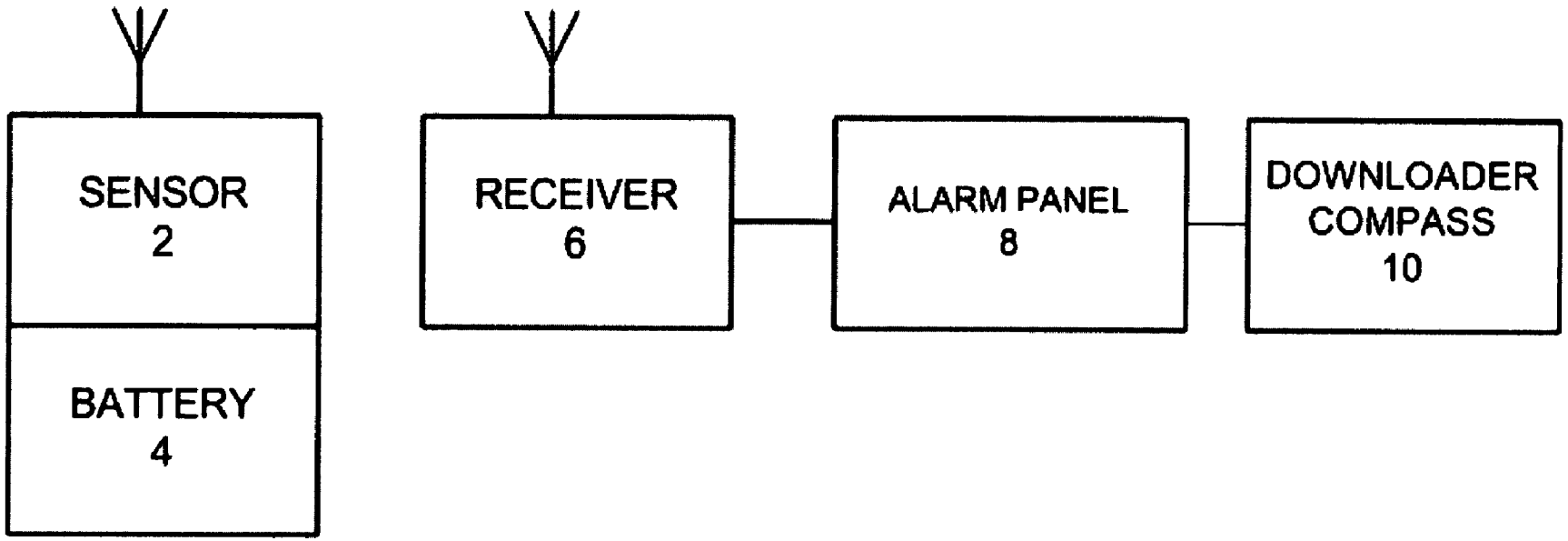
FIG. 2 is a schematic block diagram of a wireless security system incorporating the present invention.

Referring now to the drawing, there is shown in FIG. 2 a wireless security system including a conventional sensor, such as a passive infrared (PIR) sensor 2 having a single sensitivity level operatively connected. The sensor 2 is coupled to a battery 4, and includes an internal transmitter and an antenna for transmitting a signal corresponding to the sensed parameter. Commercially available devices of this type are manufactured and sold by Honeywell and identified by the designation Ademco 5890 or 5894. Customarily the wireless sensor 2 is constructed and programmed to issue a signal at a predetermined interval to confirm the presence and operability of the sensor 2. For example, such a signal may be sent at an interval of once every hour to confirm to an alarm panel that the sensor has not been stolen or become inoperative.

The signal from the sensor 2 is transmitted to a receiver 6 that is configured to receive the signal from the sensor 2. Commercially available devices of this type are manufactured by Honeywell and are identified by the designation Ademco 5881.

The receiver 6 is physically connected to an alarm panel 8. A commercially available alarm panel 8 for such an application is manufactured by Honeywell and identified by the designation VISTA 50.

Typically, the alarm panel 8 is coupled by a phone line to a microcomputer running control software whereby the alarm panel 8 may be remotely controlled. One commercially available software program for such purposes is marketed by Honeywell and identified as the Ademco Compass Downloader 10. This software permits a user to remotely program and control an alarm system. The user may do so from the comfort of an office and will allow the user to download and upload alarm control information, to compare the upload and saved information, and to view the results either on a screen or any printed report. The Compass Downloader enables programming from an office prior to installation. Alternatively, initial programming can be downloaded from a remote location or at a job site using a personal computer with a commercially available serial module such as the Honeywell/Ademco 4100SM (where the alarm panel supports it).

The Ademco Compass Downloader for Windows Software 10 is network compatible software that provides a quick and easy method for planning, designing and communicating with the alarm panels. With this software the user can upload system programming that has been manually entered into the panel, or previously downloaded. The Compass change feature reviews all system changes initiated by the download operator within the current session. A complete record of system modifications and the history of an account are also available.

As noted above, known security systems include a special zone type known as Entry/Exit type. When the occupant of the building is in this zone, the occupant is allowed a preset time to exit the protected premises after arming the security system. This preset time is known as the "exit delay" period. Similarly the end user is allowed a preset time referred to as a "entry delay" period intended to allow the user time to disarm the system once an entry door is opened while the system is armed. The exit delay is programmed by the installer of the system and is typically between 30 and 120 seconds in length but may be longer. Some known security systems include an automatic "reset" of the exit delay back to its originally programmed maximum delay when an entry door has been reopened before the exit delay expires.

In one form of a known system, the programmed exit delay is 60 seconds. After 30 seconds expires the end user leaves the premises and closes the exit/entry door. If the end user reenters the entry/exit door before the exit delay expires, the delay time is reset to 60 seconds. This allows the end user sufficient time to enter the premises and exit again without initiating an alarm. More specifically, this operational feature reduces false alarms.

Various embodiments of the present invention include a presence detector, such as a motion detector or floor mat switch, that cooperates with the system to cause the exit delay to be reset automatically in the event that motion, or other indication of the presence of a person, is detected within the home while the exit delay is in progress. Although the present invention may be described in terms of resetting a pre-existing exit alarm delay, it will be understood that some embodiments of the present invention may provide apparatus which functions independently of any other exit delay army apparatus. More specifically some embodiments of the present invention may provide an exit arming delay initiated by a presence sensor and this exit arming delay is independent of any other exit arming delay. Thus, in some embodiments of the present invention there may be no other exit arming delay, only an exit arming delay initiated by a presence sensor. Conversely, still other embodiments may have at least two systems for providing exit arming delays. For example, the two may function cooperatively and may merely reset a common mechanism or circuit upon the occurrence of a predetermined event.

Referring now to FIG. 2 there is shown a user 20 who has been not yet passed through the doorway 26. The movement of the user 20 is detected by a motion detector 22. The motion detector 22 is coupled to the control or alarm panel 8. The Motion may be detected by the use of interior motion protection device such as passive infrared motion detectors (PIR) and other types of motion detectors such as microwave, dual-tech, floor pressure mats, etc. (Dual-technology motion detectors use a circuit that requires both devices to detect motion before an alarm is sounded. A bird landing on an outside window sill might trip the microwave device but not the infrared device, so no false alarm is transmitted.) Thus, a wide range of motion detectors is known in the art.

One such example is the product manufactured by Honeywell and identified as the Ademco 40 Lbs Pet Immune Motion Detector. This device is a PIR device for applications where pets up to 40 pounds may roam. It has a pattern of 35'×45' and is immune to pets up to 40 pounds; typically it is mounted in the back corner of a room for best results. Pet immunity greatly reduces false failure signals, while maintaining watchful eye on the protected premises. Every such sensor contains a serial number that is as distinctive as a fingerprint. This unique "fingerprint" serves two purposes: The location of an intruder within the area protected by an alarm system can be identified at both the control panel and the central station. Wireless signals easily penetrate walls and can travel several hundred feet. Neighboring installations, which may use similar wireless systems, can receive these signals as well as the desired receiver. However, due to the uniqueness of each Point ID, it is virtually impossible for any peripheral in the neighboring system to have the same serial number. Any of such devices may be used in various embodiments of the present invention.

The exit delay reset in accordance with a preferred embodiment of the invention is in addition to the door open and close reset described above. The result is that the exit delay may be automatically reset if the system detects that people are still moving about the protected premises while the exit delay is getting close to expiring. This invention does not require the end user to have previously exited the home as in the known door open/close method described in the preceding paragraph.

End users of security systems require an error free and automatic method to provide exit delay reset when they require more time to exit their home or business when needed. Some existing methods require exiting and reentering the exit door or a key press at the keypad. The apparatus and method in accordance with the present invention requires neither of these and will aide in reducing false alarms.

In the apparatus and method according to the present invention, the exit delay reset is activated "automatically" when "motion is detected" within the premises during the exit delay period. As an example, if the user arms the system and needs to go back into the home (or never leaves the home) to get another item, the motion is detected by the sensor 22, the sensor 22 notifies the alarm panel 8, and the alarm panel 8 initiates and exit delay reset in accordance with predefined settings. Ordinarily the installer will use a programmable zone list to specify which motion detector causes the security system to automatically reset the exit delay for a specific entry/exit door to a preprogrammed time thus reducing the incidence of false alarms. No user intervention is required and the user does not have to exit and reenter the premises. Some embodiments of the present invention will include several programmable options to limit the number of resets and to control the time interval between resets.

The alarm panel 8 includes a microprocessor and memory which cooperates with software that is commercially available or within the skill of practitioners in the programming arts. The software may include, for example, the following new programming fields in security system for this logic in accordance with one form of the present invention:

(1) Enable exit delay reset by motion (1 or 0, or Yes and No) This field enables or disables this new logic.

(2) Number of motion exit resets permitted=can be 1 or 2 (or more) This insures that the system does not continue to reset indefinitely.

(3) Time duration between resets=02-20 seconds (or longer) This is to prevent constant movement in front of a motion detector causing too many resets. In some embodiments of the present invention it may be preferable to only allow the second reset 30 seconds after the first if there is still movement at the same motion detector.

(4) Time duration before first allowable reset=10-60 seconds (or longer) This field allows you to control when the first reset may occur. The user may need to walk by a motion detector to get to the door and it is not desirable to initate a reset too soon. For example, if the system had a 60 second exit delay, it might be desirable to have no reset occur until motion is detected after 30 seconds has already elapsed.

(5) Optionally provide a new zone List in which the dealer programs the applicable RF or hardwired motions zones. This is a list of zones that will be included in the motion reset logic. These are typically "interior" motion detector protection zones. Each zone is programmed into what is referred to in the art as a zone list. The applicable zones may be proximate to the usual exit door or may include the entire building. Other systems may not include a zone list. In such systems any presence detection in the building will initiate an entry delay.

The specific numbers noted are specified only for the purpose of illustration and are not a limitation on the scope of the invention. Although the preferred embodiment of the present invention will utilize a microprocessor, and memory that are conventionally part of the security system alarm panel, those skilled in the art will recognize that hardware embodiments of the present invention may also achieve the same purposes. It will be appreciated that the systems and methods of the present invention are described with reference to block diagram illustrations. It should be understood that blocks of the block diagrams illustrations, and combinations of blocks in the block diagrams illustrations, respectively, may be implemented by computer program instructions. These computer program instructions may be loaded onto a general purpose computer, special purpose computer, or other programmable data processing apparatus to produce a mechanism, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the functions specified herein. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified herein.

Accordingly, blocks of the block diagrams illustration support combinations of means for performing the specified functions, combinations of steps for performing the specified functions and program instruction means for performing the specified functions. It will also be understood that each block of the block diagrams illustration, and combinations of blocks in the block diagrams illustrations, can be implemented by special purpose hardware-based computer systems that perform the specified functions or steps, or combinations of special purpose hardware and computer instructions.

While the invention has been described in terms of control functions disposed at an alarm panel 8, it will be understood that in other embodiments of the invention these control functions may be disposed at other parts of the system. The term "presence detector" as used herein includes, but is not limited to, motion detectors, floormat switches, and the like that sense the presence of a person.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A security system for protecting a building which comprises:

a first presence sensor;

an alarm panel that includes a microprocessor and memory;

a switch for initiating an arming sequence an exit arming delay providing an interval for a user to exit the building after arming the security system; said exit arming delay being varied in response to said first presence sensor sensing a presence in the building subsequent to operation of said switch for initiating an arming sequence.

2. A security system as described in claim 1 wherein said exit arming delay is also a function of a preset finite amount of time.

3. The security system as described in claim 1 further including wherein said exit arming delay interval is programmable.

4. The security system as described in claim 2 wherein said preset finite amount of time exit arming delay may be initiated more than one time.

5. The security system as described in claim 3 wherein said preset finite amount of time exit arming delay may be initiated more than one time and the maximum number of said resets is programmable.

6. The security system as described in claim 2 wherein said exit arming delay cannot occur until a predetermined interval has elapsed subsequent to operation of said switch for initiating an arming sequence.

7. The security system as described in claim 1 wherein the first exit arming delay within a predetermined period cannot occur until a predetermined interval has elapsed.

8. The security system as described in claim 7 wherein the first of such exit arming delays within a predetermined period cannot occur until a predetermined interval has elapsed and that predetermined interval is programmable.

9. The security system as described in claim 1 further including a zone system and said at least a first motion detector is in a zone proximate to a predefined exit door.

10. The security system as described in claim 1 further including an exit arming delay initiated by a predefined door opening within a predefined time period after the security system has been armed.

11. A method for protecting a building which comprises:

providing at least a first presence sensor;

providing an alarm panel that includes a microprocessor and memory;

providing a switch for initiating an arming sequence;

providing an exit arming delay for thereby providing an interval for a user to exit the building after arming the security system; and varying the exit arming delay in response to the first presence sensor sensing a presence in the building subsequent to operation of the switch for initiating an arming sequence.

12. The method as described in claim 11 wherein the step of providing an exit arming delay further includes providing an exit arming delay that is also a function of a preset finite amount of time.

13. The method as described in claim 11 wherein the step of providing an exit arming delay includes providing an exit arming delay wherein the preset finite amount of time is programmable.

14. The method as described in claim 11 wherein said step of providing an exit arming delay includes allowing the preset finite amount of time exit arming delay to be initiated more than one time.

15. The method as described in claim 11 wherein the step of providing an exit arming delay includes allowing the preset finite amount of time exit arming delay to be initiated more than one time and the number of times is programmable.

16. The method as described in claim 11 wherein the step of providing an exit arming delay includes providing an exit arming delay includes allowing the preset finite amount of time exit arming delay to be initiated more than one time after a programmable time interval after operation of the switch for initiating an arming sequence.

17. The method as described in claim 11 wherein the step of providing an exit arming delay includes providing an exit arming delay that cannot occur within a predetermined period cannot occur until a predetermined interval has elapsed.

18. The security system as described in claim 16 wherein the step of providing an exit arming delay includes providing that the first of such exit arming delay within a predetermined period cannot occur until a predetermined interval has elapsed and that predetermined interval is programmable.

19. The method as described in claim 11 further including providing a zone system and the step of providing at least a first presence detector includes providing the presence detector in a zone proximate to a predefined exit door.

20. The method as described in claim 11 further including a still further entry delay initiated by a predefined door opening within a predefined time period after the security system has been armed.

* * * * *